US005215217A

United States Patent [19]

Leslie

[11] Patent Number: 5,215,217

[45] Date of Patent: Jun. 1, 1993

[54] PRESSURE SUPPLY UNIT

[75] Inventor: Michael J. Leslie, Tasmania, Australia

[73] Assignee: Dispak Pty. Ltd., Tasmania, Australia

[21] Appl. No.: 671,868

[22] Filed: Jun. 3, 1991

[30] Foreign Application Priority Data

Oct. 7, 1988 [AU] Australia ..... PJ0823

[51] Int. Cl.[5] ..... B65D 83/00

[52] U.S. Cl. ..... 222/5; 222/399; 239/309; 239/337

[58] Field of Search ..... 222/4, 5, 396, 399; 239/309, 353, 337

[56] References Cited

U.S. PATENT DOCUMENTS

| | | | |
|---|---|---|---|
| 2,220,645 | 11/1940 | Girerd | 417/555.1 X |
| 2,873,051 | 2/1959 | Hamburg et al. | 222/396 |
| 3,127,059 | 3/1964 | Lawrence, Jr. et al. | 222/399 |
| 3,352,456 | 11/1967 | Swineford | 222/5 |
| 3,459,331 | 8/1969 | Hogg | 222/5 |
| 3,563,423 | 2/1971 | Wilson | 222/396 |
| 4,177,828 | 12/1979 | Vache | 222/5 X |
| 4,456,155 | 6/1984 | Miyata et al. | 222/396 |
| 4,632,276 | 12/1986 | Makino | 222/399 X |

FOREIGN PATENT DOCUMENTS

| | | | |
|---|---|---|---|
| 0191105 | 8/1986 | European Pat. Off. . | |
| 1272060 | 7/1968 | Fed. Rep. of Germany | 222/5 |
| 1287803 | 2/1962 | France . | |
| 59-217100 | 12/1984 | Japan . | |
| A355167 | 8/1961 | Switzerland . | |
| 9015377 | 12/1990 | World Int. Prop. O. | 222/399 |

*Primary Examiner*—Andres Kashnikow
*Assistant Examiner*—A. Pomrening
*Attorney, Agent, or Firm*—Kinzer, Plyer, Dorn, McEachran & Jambor

[57] ABSTRACT

A pressure supply unit to supply pressure to a dispensing can, the unit being attached to a gas bulb containing gas under a predetermined pressure. The unit has a chamber pressurized to the desired can pressure, and one wall of the chamber is a diaphragm connected to a needle valve for regulating gas flow from the bulb. A reduction of can pressure causes the diaphragm to move the needle to release gas from the bulb.

4 Claims, 4 Drawing Sheets

PRESSURE SUPPLY UNIT

This invention relates to a pressure supply unit, more particularly for a unit to supply the pressure required for the dispensing of an aerosol or spray or stream from a closed container such as a can.

BACKGROUND OF THE INVENTION

In Australian Patent Application No. AU-A-78219/87 there is described a unit which will controllably release the gas from a pressurized bulb or the like, this release of pressure being controlled during the dispensing of the product from a can in which the unit is positioned.

Also there is known U.S. Pat. No. 4,456,155 for an aerosol spray device in which a gas bulb is positioned in the container, this being sealingly mounted within the container by being attached to an aperture in the bottom of the container, so that means can be available to hold the gas regulating position in an inoperative condition until the unit is inserted and the container sealed.

Japanese Patent No. 62066873 discloses a fire extinguisher which uses a gas bomb containing a mixture of nitrogen gas and carbon dioxide gas.

It is an object of this invention to provide a unit with the least number of parts and also it is a still further object to provide a unit which has the provision of a fail safe property, and is also self-regulating.

BRIEF STATEMENT OF THE INVENTION

Thus there is provided according to the invention a self-regulating pressure supply unit to supply a constant gas pressure from a pressurized cylinder to the interior of a can to dispense a product, said unit being inserted into said can and comprising a body attached to said pressurized cylinder and including a piston, a needle valve attached to said piston, said needle valve piercing a membrane sealing said pressurized cylinder and regulating gas flow from pressurized cylinder, said piston being attached to means for moving said piston, said means for moving the piston comprising a wall of a chamber pressurized to said constant gas pressure, spring means and means to apply the internal can pressure to said means for moving the said piston whereby a reduction in internal can pressure will move said means to move said piston due to differential pressure thereon.

BRIEF DESCRIPTION OF THE DRAWINGS

In order to more fully describe the invention, reference will now be made to the accompanying drawings in which.

DESCRIPTION OF THE PREFERRED EMBODIMENT

Figure 1:
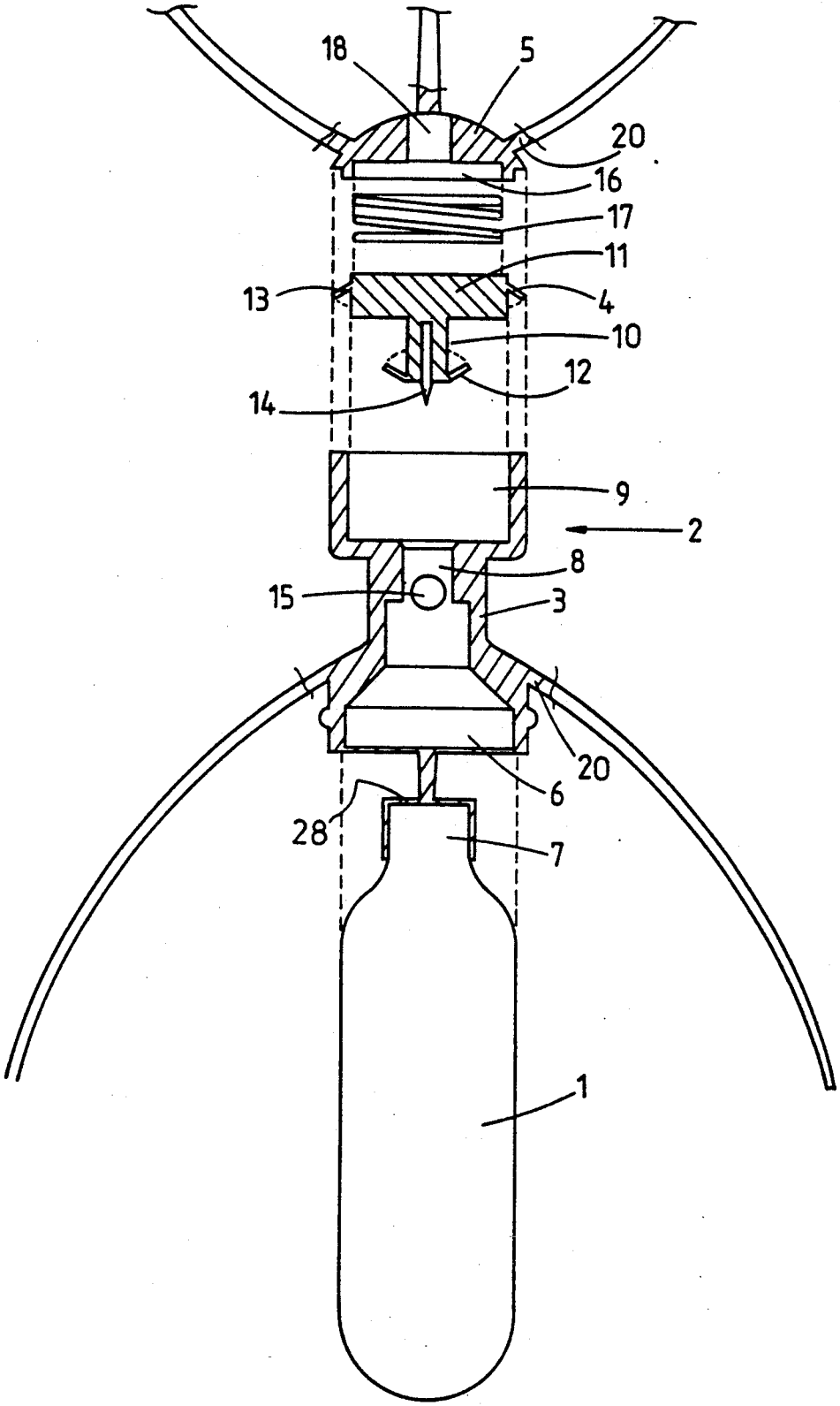
FIG. 1 is a cross-sectional view of one form of the invention in exploded form.
Figure 2:
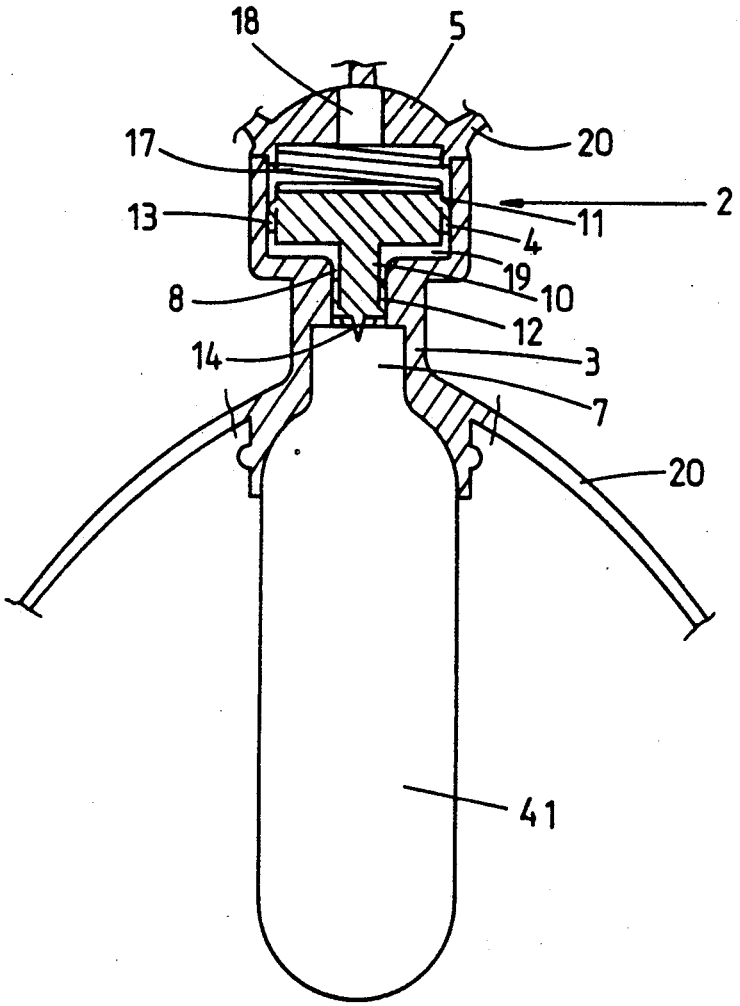
FIG. 2 is a cross-sectional view of the parts in assembled form.

Referring firstly to FIG. 1, there is shown a gas bulb 1 which may contain an inert gas such as carbon dioxide, nitrogen or the like.

The unit 2 comprises a body 3, a piston 4 and a cap 5.

The body 3 includes a sleeve-like portion 6 which is shaped to engage the sides and neck 7 of the bulb, and is also provided with a stepped bore having a first bore 8 and a second bore 9 in which the piston operates, the piston having a first piston portion 10 operating in the bore, and a second piston portion 11 operating in the bore 9.

The first portion 10 has a skirt 12, this skirt being positioned facing toward the second piston portion 11, and the second piston portion 11 has a skirt 13, this skirt 13 facing towards the first piston portion. Both these skirts are each similar to a cup or bucket washer.

The piston 4 has attached thereto in the first piston portion 10 a needle valve 14 which protrudes from the first piston portion to pierce the end membrane 28 of the bulb and also to seal on the so pierced membrane.

The body 3 also has in the vicinity of the end of the bulb 1 an aperture 15 opening from the interior to the outside thereof.

The end cap 5 has a recess 16 housing a spring 17 which acts on the second piston portion 11.

The unit 2 is assembled onto the bulb 1 and in doing so on insertion of the bulb 1 into the body 3 with the spring forcing the piston downwardly, the needle valve will pierce the sealing membrane of the gas bottle and due to the shape of the needle valve a small hole is formed, and in doing so the needle valve will deflect the membrane around the hole to form a flared hole in the membrane, the needle thus sealing against this flared portion.

Figure 5:
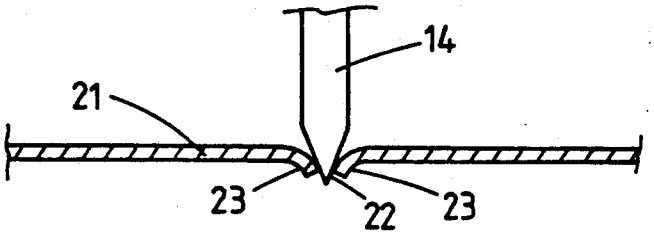
FIG. 5 is a part-sectional view in enlarged scale of the needle valve and the membrane on the gas bulb.

By reference to FIG. 5 it will be seen that the needle 14 will pierce a flared hole 22 in the membrane 21, and in so doing will deflect the edge portions 23 of the membrane 21 to form the flared hole 22, the needle valve 14 thus sealing on the flared edge portions 23. Surprisingly it has been found that this forms an effective seal, the gas pressure within the bulb maintaining the flared portions 23 against the needle.

Also there are provided a plurality of whisker-like protrusions 20 which compress to fit through the 25 mmϕ neck of any aerosol can and expand inside the can to prevent any part of the body or cylinder coming into contact with the can or the aerosol outlet valve.

The unit and bottle are then positioned in the can containing the substance to be dispensed, and in this operation and during the sealing of the cap on the can, the can is pressurized to the desired operating pressure of the can.

Upon the can being pressurized, this pressurizing gas can enter through apertures 18, past the skirt 13 into chamber 19 formed beneath the second piston portion 11. Also some gas could pass through the aperture 15 and up past the skirt 12 in the first piston portion so that after a short period of time the chamber 19 is pressurized to the same pressure as the can so that the can pressure is acting both on the top and bottom of the second piston portion with the spring 17 assisting in closing of the needle valve 14.

Upon depression of the aerosol valve on the can, and the consequent dispensing of the contained material, there will be an immediate reduction in pressure in the can, and thus a reduction in pressure on the surface above the second piston portion 11, but due to the positioning of the skirts 12 and 13, there will be no reduction in pressure in the chamber 19, and thus this pressure acting on the bottom of the second piston portion 11 will cause the piston 4 to rise thus moving the needle valve 14 away from its seat and allowing gas from the bulb to escape through aperture 15 into the can. Upon the cessation of dispensing of the product, this gas escapes until the original pressure is achieved, that is equal to the pressure in the chamber 19, thus the can pressure then is operating on the top of the second piston portion 11 and this in conjunction with the force exerted by the spring, closes the valve. Hence the unit is self-regulating to the desired can pressure.

Figure 3:
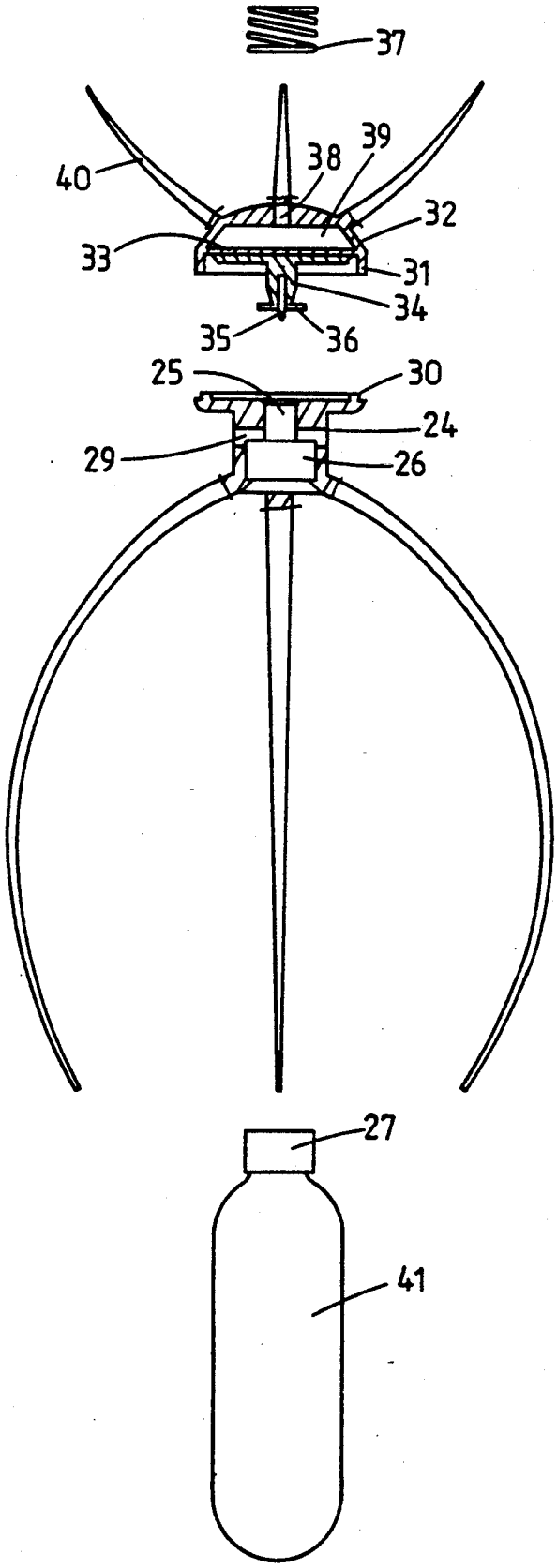
FIG. 3 is a cross-sectional view of a further form of the invention in exploded form.
Figure 4:
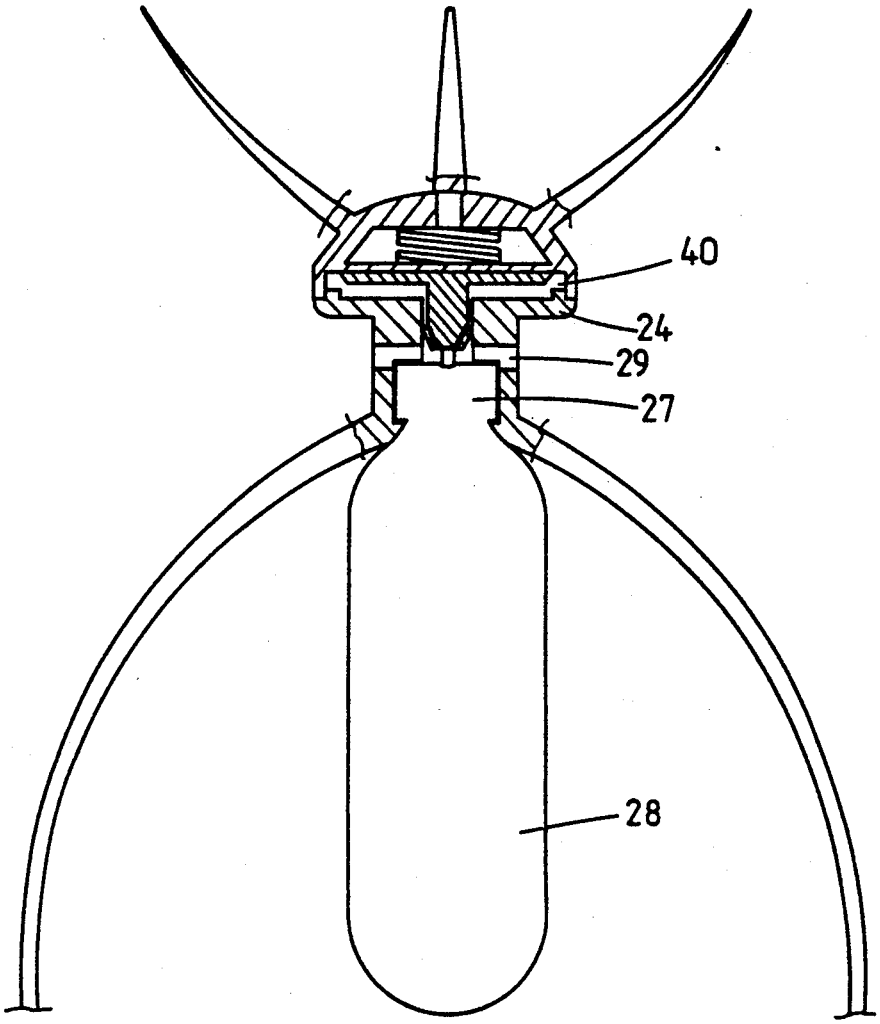
FIG. 4 is a view of the parts in assembled form.

Turning now to FIGS. 3 and 4 there is shown a further embodiment of the invention.

The body 24 has a central bore 25 which opens into a larger bore 26, the larger bore 26 being adapted to receive the neck 27 of the gas bulb 41, a radial passage 29 opening into the top of the larger bore 26. The top of the body 24 has a peripheral flange 30 to seal with a peripheral flange 31 on a cap 32.

The cap 32 has a diaphragm or membrane 33 extending across its open end, and to the membrane 33 there is attached a piston 34 defining a one way sealing means. The needle valve 35 is fitted centrally on the piston 34 and protrudes from the end thereof. The end of the piston 34 is provided with a flexible extending skirt 36.

The cap 32 also is provided with a spring 37 which is positioned within the cap to bear on the membrane 33 on the opposite side of the membrane to the piston 34. In the cap there is also a passage 38 which connects to space 39 above the membrane 33 to the interior of the can.

The body 24 and the cap 32 are each provided with flexible arms or fingers 40 to position and hold the unit and gas bulb 41 within the can.

When the unit is assembled the piston 34 is positioned in the bore 25, the skirt 36 folding back to form a cup washer as shown in FIG. 4. Hence once inserted and the unit is subject to the can pressure, the gas pressure will pass upwardly into the space 40 beneath the membrane 33. Hence this space 40 is then pressurized to the can pressure and thus this is the self-regulating pressure.

As there is can pressure on both sides of the membrane, then the spring will cause the needle to close the aperture formed in the metallic sealing membrane of the bulb.

On reduction of can pressure, as by operation of the dispensing valve of the can, there is thus a reduction of pressure on the spring side of the membrane, and as there is the higher can pressure on the piston side of the membrane, then the membrane moves upwardly against the spring pressure to cause the needle valve to open the aperture in the bulb to thus allow escape of gas. Hence it will be seen that the unit is self-regulating and will maintain the pressure in the can at the desired set pressure.

Thus, it will be seen that there is a self-regulating feature of the piston and valve, for example if the escape of gas from the bulb is greater than the rate to which the material is being dispensed, there will be a self-regulating feature of the valve. Also, due to the fact that the spring always tends to close the valve, there is a fail safe aspect of this construction.

Thus, it will be seen that with this construction that without any alterations at all, the unit is adapted to be suitable for the use and dispensing at various pressures, whether these be at 40 pounds per square inch, 60 pounds per square inch or 80 pounds per square inch, due to the fact that on assembly and with the pressurizing of the can to the desired pressure, this desired pressure will cause the gas to pass the seals and thus, pressurize the area of chamber 19 to the can pressure and then the unit always operates at this pressure.

It will be seen in this embodiment that care should be taken in the selection of the diameters of the two piston portions, the second piston portion or the top diameter being loaded to the power function, and the first piston portion or the bottom as shown in the drawings is related to the loss factor in the expanded mode and these diameters are so chosen so that the effective operation is achieved.

Thus, it will be seen that according to the invention there is provided a unit which is of minimum parts in its construction, and which thus allows the use of an aerosol dispenser with an inert gas, such as nitrogen, and which thus can be used with a variety of products to be dispensed.

Although this form of the invention has been described in some detail, it is to be realized that the invention is not to be limited thereto but can be varied within the spirit and scope of the invention.

I claim:

1. A self-regulating pressure supply unit to supply a constant gas pressure to the interior of a can having a dispensing valve to dispense a product from the interior of the can, said pressure supply unit being inserted in the interior of said can and comprising a body, a pressurized cylinder attached to said body; said body having a stepped bore therein formed by a smaller bore and a larger bore, a first piston in said smaller bore and a second piston in said larger bore, said first piston connected to said second piston, said first piston having a needle to pierce and seal on a membrane sealing said pressurized cylinder, a chamber enclosed by said first and second pistons and said body, a one-way valve on said first piston allowing passage of gas into said chamber, a second one-way valve on said second piston allowing passage of gas into said chamber, said pistons being subject to pressure in said can whereby gas can pass through said first and second one-way valves to pressurize said chamber to can pressure, a spring positioned between said second piston and said body, a passage through said body at said smaller bore, whereby on actuation of the dispensing valve, can pressure is reduced so that can pressure in said chamber moves said first and second pistons to move the needle valve to allow passage of gas from the pressurized cylinder through said passage into the interior of the can.

2. A pressure supply unit as defined in claim 1 wherein said body further comprises a cap, said spring acting between said cap and said second piston.

3. A pressure supply unit as defined in claim 2 wherein said cap has an aperture opening to the can interior.

4. A pressure supply unit as defined in claim 1 wherein said needle forms a flared aperture in said membrane, said flared aperture forming a one way seal for the needle.

* * * * *